United States Patent [19]

O'Brien

[11] 4,131,360

[45] Dec. 26, 1978

[54] DUPLEX REPRODUCTION SYSTEM EMPLOYING COPY SHEET CLEANER

[75] Inventor: John F. O'Brien, Webster, N.Y.

[73] Assignee: Xerox Corporation, Stamford, Conn.

[21] Appl. No.: 801,111

[22] Filed: May 27, 1977

[51] Int. Cl.[2] ..... G03G 21/00

[52] U.S. Cl. ..... 355/15; 96/1 R; 118/652; 355/23; 355/26

[58] Field of Search ..... 355/3 R, 15, 23, 25, 355/26; 96/1 R; 134/1; 118/652, 656–658; 427/18, 21

[56] References Cited

U.S. PATENT DOCUMENTS

| | | | |
|---|---|---|---|
| 3,369,917 | 2/1968 | Granzow et al. | 118/657 X |
| 3,841,754 | 10/1974 | Drexler et al. | 355/26 X |

*Primary Examiner*—Richard L. Moses

*Attorney, Agent, or Firm*—James J. Ralabate; Clarence A. Green; William A. Henry, II

[57] ABSTRACT

A duplex reproduction system which produces duplex copy sets in collated separated stacks from a stack of precollated documents includes a document feeding apparatus which feeds a stack of documents individually onto the platen of a copy processor for producing copies of each document. The copy sheets are transported to a receiving tray in a sorting apparatus which does not sort the copy sheets when producing the first side of the duplex copies. As an improvement, the copies are cleaned on the back (non-image) sides thereof to remove unfused toner. The documents are reloaded into the document feeding apparatus for feeding the documents with the second side onto the platen of the processor. On the simplex or first pass a circuit disables the sorting function of the sorting apparatus. The copy sheets are removed from a single receiving tray of the sorter for a second or duplex run. On the second pass the copies are cleaned on the first side and distributed sequentially to the different trays of the sorting apparatus which is now energized to produce duplex copy sets in separate collated bundles without rearranging or reshuffling of the documents or copy sheets.

2 Claims, 2 Drawing Figures

DUPLEX REPRODUCTION SYSTEM EMPLOYING COPY SHEET CLEANER

BACKGROUND OF THE INVENTION

This invention relates in general to a duplexing system and in particular to an improved apparatus combining copier, document feeder, copy sheet cleaning, and a sorter cooperating to produce duplex copies in collated order from precollated documents without rearranging the documents or copies. This application incorporates by reference U.S. Pat. No. 3,567,214 issued on Mar. 2, 1971, on a document feeder, U.S. Pat. No. 3,460,824, issued on Aug. 12, 1969 on a Sheet Sorter and U.S. Pat. No. 3,841,754 issued Oct. 15, 1974 to Edward E. Drexler et al. for a Duplex Reproduction System each being commonly assigned to the same assignee as the present application.

A variety of machines are known for creating copy xerographically on a commercial basis. For the most part, such machines in present commercial use are limited to making a limited number of reproductions from an original on one side. It is also known to produce two sided or duplex copies as described, for example, in U.S. Pat. No. 3,615,429. Recently, there has been a demand to produce duplex copies which can be sorted in collated stacks from a precollated order of documents fed to a platen in a minimum of time without rearranging or reshuffling of documents or copies by the machine operator.

A major problem with duplex report reproduction in some copiers has been toner deposition on the back (non-image) side of the copy during the simplex pass. This is usually caused by soiled transport belts and unfused toner particles. In any machine which uses a high thermal gradient fuser which fuses the toner on the imaged side copy sheets and does not fuse toner on the side of the copy sheet not being imaged (such as CHOW or flash fusers), the toner on the backside of the copy is not fused as the copy passes through the fuser and is easily brushed off the copy sheet. However, the marks on the side of the sheet being imaged are fused on the sheet and the copies are fed back through the machine in the duplex mode and similar (unfused) spots are deposited on the first (simplex) side of the copy. If the toner deposited on the blank side of the sheet during the first pass is not removed before duplexing, it will be fused onto the copy during the second pass, resulting in permanent degradation of copy quality.

Copiers in the past have employed cleaning devices but none have been used to clean the non-image side of copies after they have passed through the fusing station. For example, U.S. Pat. No. 3,679,302 to Frederic G. Ludwing discloses a copying system using two fusing steps and a brushing step with the latter being used to remove toner particles from the simplex side copy sheet after the first fusing step. Joseph Fantuzzo et al, U.S. Pat. No. 3,566,076 shows the use of a cleaning brush in a xerographic machine used to remove background from the simplex side of a copy after fusing has taken place. Shelffo et al in U.S. Pat. No. 3,387,586 and D. B. Granzow et al in U.S. Pat. No. 3,369,917 both disclose removing any iron filings that inadvertently may have become deposited on the back of sheets passing through a developer housing. A brush is shown in U.S. Pat. No. 3,682,738 issued to J. H. Smith, Aug. 8, 1972, used to shake loose powdered materials not adhered to a fabric to improve removal of the powdered material by a suction device.

Accordingly, it is an object of the present invention to improve copier/duplicator output.

Yet another object of this invention is to insure clean duplexed copies with consequently improved copy quality.

These and other objects of the instant invention are obtained generally speaking by employing a background cleanup or toner removal brush on the side of the copies not being imaged after the copy has passed through the fusing station and preferably after the last processor transport.

BRIEF DESCRIPTION OF THE DRAWINGS

For a better understanding of the invention as well as other objects and further features thereof, reference is had to the following detailed description of the invention to be used in conjunction with the accompanying drawings, wherein.

DESCRIPTION OF THE PREFERRED EMBODIMENT

Figure 1:
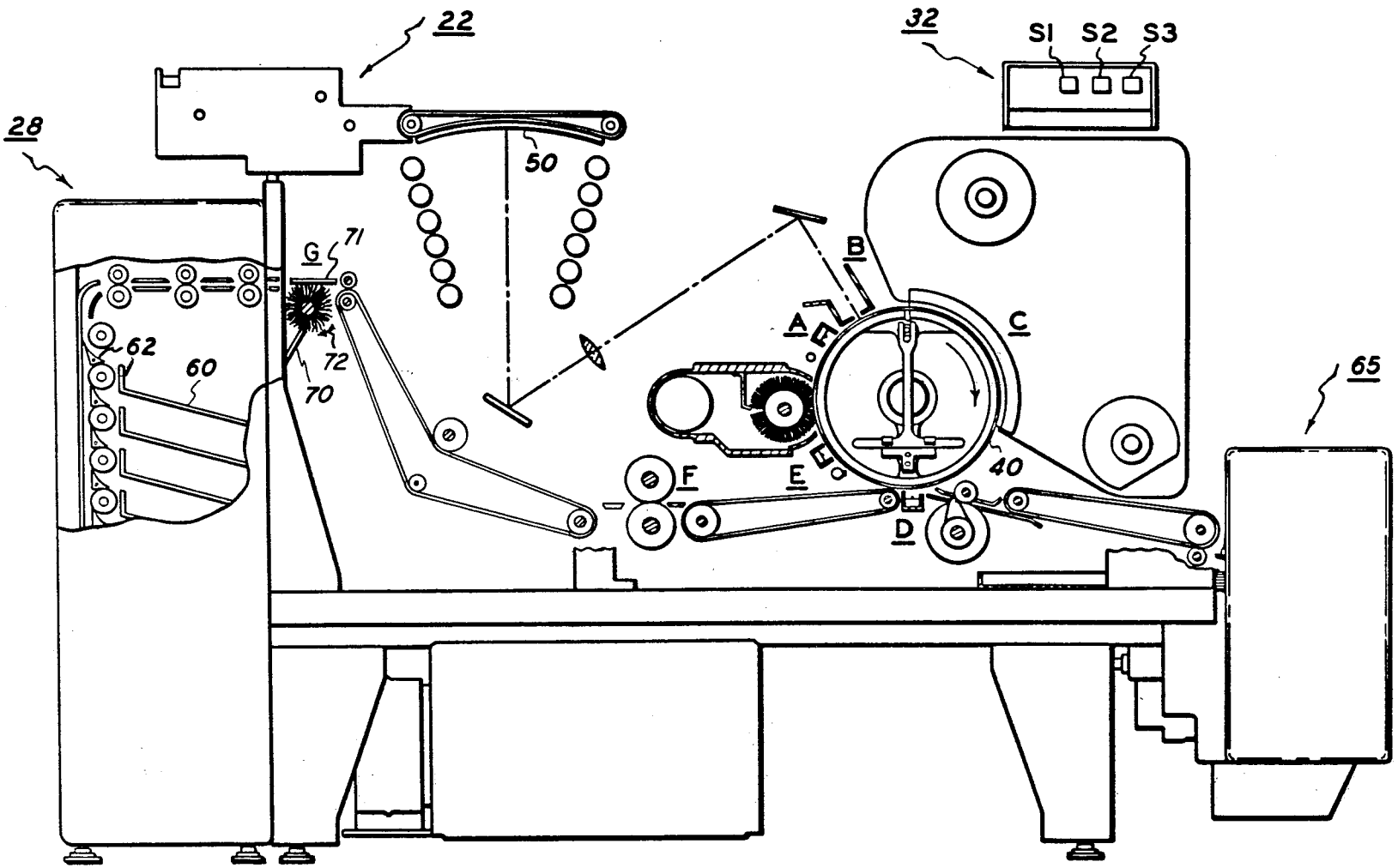
FIG. 1 illustrates schematically a duplex xerographic reproduction system including a document feeder, a brush cleaner and a sorter in accordance with the instant invention.

As shown schematically in FIG. 1, the duplex xerographic reproduction system comprises a document feeding apparatus 22, positioned on a xerographic processor 25 which transports copy sheets to a sorting apparatus 28. A control panel 32 includes the usual counters and buttons as well as switch buttons S1 for START/PRINT, S2 for sorter ON and S3 for document feeder ON. The processor includes a drum shaped surface 40 including a photosensitive top surface layer. This surface is mounted on a shaft journaled in a frame to rotate in the direction of the arrow to cause the drum surface sequentially to pass a plurality of xerographic process stations.

For the purpose of the present disclosure, the several xerographic processing stations in the path of movement of the drum surface may be described functionally as follows:

A charging station A, at which a uniform electrostatic charge is deposited on the photoconductive layer of the xerographic drum;

Exposure station B, at which a light or radiation pattern of copies to be reproduced is projected onto the drum surface to dissipate the drum charge in exposed areas thereof thereby forming a latent electrostatic image on a copy to be produced;

A developing station C, at which a xerographic developing material including toner particles having an electrostatic charge opposite to that of the electrostatic latent image are cascaded over the drum surface, whereby the toner particles adhere preferentially to the high charge regions of the latent electrostatic image to form a xerographic powdered image of the original being reproduced;

A transfer station D, at which the xerographic powdered image is electrostatically transferred from the drum surface to a transport sheet material or drum surface;

A drum cleaning and discharge station E, at which the drum surface is brushed to remove residual toner particles remaining thereon after image transfer, and at which the drum surface is exposed to a relatively bright light source to effect substantially complete discharge of any residual electrostatic charge remaining thereon;

A fusing station F at which the powdered image is permanently affixed to the sheet material which is transported to a sorting apparatus 28; and A background cleanup station G, at which unfused toner particles are removed from the side of a sheet not being imaged as well as toner particles deposited on that side from the transport belts.

For a more detailed description of the copy processing stations reference is had to U.S. Pat. No. 3,301,126 to Osborn et al which is commonly assigned.

In accordance with the present invention a stack of documents are placed in a document feeding apparatus 22 in such a manner as to feed documents to the platen 50 of the processor. The operation of the document feeding apparatus is such that one document is fed to the platen to produce the desired number of copies and then advanced from the platen to enable the next document to be positioned in overlying relationship to the platen as described in the commonly assigned aforementioned patent. The sorter apparatus 28 comprises trays 60 each having a gate 62. In the first pass, the copy sheets are cleaned on their back sides by background cleaning means G after passing through the fuser station F in order to remove any residual toner not fused by the fuser as well as any toner deposited on the backside of the paper by the transportation belts and are collected in the top sorter tray only as will be described more fully hereinafter. After the first side of each document has been copied the documents are inserted in the document feeding apparatus and the second side copied. Here, too, the side of copy sheets not being imaged is also cleaned by cleaning means G, which in this case is a brush 72, in order to remove any toner not fused to the copy and thereby improve copy quality. The copies are held in contact with the cleaning brush 72 by an interference plate 71. Toner cleaned from the copies is removed from the brush fibers by flicker bar 70.

Prior to starting the system for the duplex pass, the copy sheets are returned to the copy sheet feeder section 65 and turned over for receiving copy print on the blank side. It would be appreciated that neither the documents nor the copy sheets are rearranged or inversed to reshuffle the order of the sheets. On the second or duplex pass the copy sheets are distributed sequentially to the trays of the sorting apparatus to produce the desired number of collated and separated duplex sets in a minimum of time.

Figure 2:
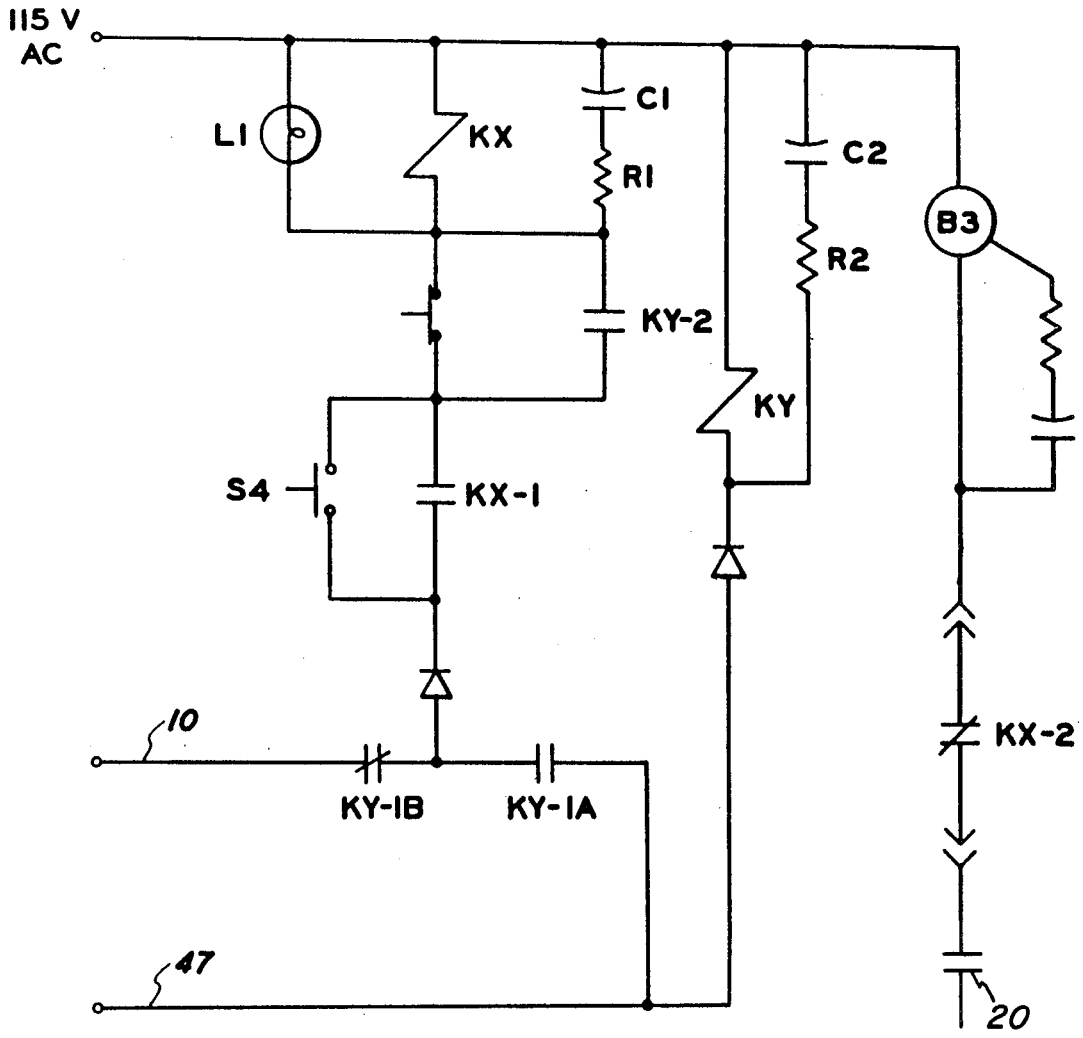
FIG. 2 is a schematic electrical diagram of the control circuit in accordance with the invention.

A better understanding of the invention can be had with the detailed description of the operation and reference to the control circuit in FIG. 2. In operation, while the system is turned on and in the standby condition, a switch S4 is closed to initiate the desired duplexing operation. When this occurs a relay KX is energized. By closing the AC circuit to line 10 which is the other side of the AC line and is always live, relay KX is energized and a normally opened contact KX-1 is closed while normally closed contact KX-2 is opened. Contact KX-1 is closed to maintain relay KX energized and lamp L1 energized indicating the duplex system is on. Contact KX-2 is opened to prevent motor B3 from being energized. Motor B3 is an indexing motor which serves to actuate gates 62 associated with each of the trays 60 of the sorting apparatus 28. Document feeding button S3 and the sorting apparatus button S2 (FIG. 1) are also pressed. Button S2 operates a relay that closes normally open contact 20 (FIG. 1). START/PRINT button S1 (FIG. 1) is pressed to energize a wire 47. The processor begins the print cycle and causes the relay KY to be energized. When the relay KY is energized normally closed contact KY-1B opens isolating relay KX from wire 10. It will be noted that relay KX is not deenergized immediately due to an RC circuit delay comprised of a capacitor C1 and a resistor R1. At the same time a normally open contact KY-1A is closed connecting relays KX to a wire 47, which is the other side of the AC line if START/PRINT is pressed, thereby maintaining relay KX energized and preventing motor B3 from indexing.

The document feeding apparatus 22 continues to feed documents one at a time onto the platen to produce the desired number of copies which are transported to the top tray 60 from the sorting apparatus 28 after they have been cleaned by background cleaning member G to remove any toner left on the side of the copying sheet not being imaged by the developer system or by the transport belts. After the last copy of the last document has been produced, wire 47 is deenergized thereby removing power from both relays KX and KY. Relay KY is coupled with an RC circuit comprised of a capacitor C2 and a resistor R2, having a longer delay than does the RC circuit comprised of capacitor C1 and resistor R1. As a result relay KX has a shorter delay or dwell for deenergizing than does relay K4 which serves to reset the system.

To produce duplex copies the documents are restacked in the document feeding apparatus. At the same time the copy sheets are removed from tray 60 and placed in copy feeding section 65 of the process with the second or blank side turned for receiving the xerographic print. The start button S1 is pressed initiating a normal operation for the sorting apparatus 28 with motor B3 operating in the usual manner to index the gates. Since the switch S4 is not closed motor B3 remains energized through contact 20 and KX-2 which are both closed and normal sorting of the copy sheets into the trays of the sorting apparatus occurs after the sheets have been again cleaned on the side remote from the xerographic drum or front side to insure a clean duplexed copy. By this instruction duplex copy sheets in book form are produced in collated separated bundles. It will be further appreciated that it is not necessary to rearrange or reshuffle the order of documents and/or copy sheets after the first pass or one side copies are produced and at the end of the duplex reproduction cycle.

While there have been shown and described and pointed out the fundamental novel features of the invention as applied to a preferred embodiment, it will be understood that omissions, substitutions and changes in the form and details of the device illustrated and its operation may be made by those skilled in the art without departing from the spirit of the invention.

What is claimed is:

1. A method of improving copy quality in duplex reproduction systems comprising the steps of:

(a) providing a processor;

(b) feeding sheets with front and back sides through said processor to receive images of document front sides on the front sides thereof;

(c) cleaning the back side of said sheets;

(d) advancing said sheets to a sheet receiving tray;

(e) refeeding said sheets through said processor to receive back side images of documents on the back sides thereof; and (f) cleaning the front side of said sheets; and receiving said sheets in an output means.

2. A method of producing separated collated duplex copy sets without rearranging documents or copy sheets comprising the steps of:

feeding documents in seriatim to the platen of a copy processor to expose one side thereof a predetermined number of times;

copying the documents on one side of copy sheets synchronously advanced through copy processing stations;

cleaning the other side of said copy sheets;

advancing the copy sheets to a single receiving tray of a sorter including a plurality of trays;

refeeding the other side of the documents to the platen of the copy processor for producing a predetermined number of copies thereof;

simultaneously refeeding the copy sheets through the copy processor stations with said other side turned to receive images of the other side of the documents;

cleaning said one side of said copy sheets; and sorting the copy sheets into said plurality of trays sequentially to produce collated duplex copy sets on the second pass.

* * * * *